US007946868B1

(12) United States Patent
Chen

(10) Patent No.: US 7,946,868 B1
(45) Date of Patent: May 24, 2011

(54) POWER ADAPTER HAVING A REPLACEABLE AND ROTATABLE PLUG

(75) Inventor: Kuan-Chih Chen, Hsin-Tien (TW)

(73) Assignee: Leader Electronics Inc., Hsin-Tien, Taipei Hsien (TW)

( * ) Notice: Subject to any disclaimer, the term of this patent is extended or adjusted under 35 U.S.C. 154(b) by 15 days.

(21) Appl. No.: 12/621,630

(22) Filed: Nov. 19, 2009

(51) Int. Cl.
*H01R 29/00* (2006.01)

(52) U.S. Cl. ..... 439/173; 439/518

(58) Field of Classification Search ..... 439/11, 439/13, 22, 131, 172, 173, 518
See application file for complete search history.

(56) References Cited

U.S. PATENT DOCUMENTS

| | | | | |
|---|---|---|---|---|
| 4,973,827 | A | 11/1990 | Nozaki | 219/521 |
| 5,613,863 | A | 3/1997 | Klaus et al. | 439/131 |
| 5,634,806 | A | 6/1997 | Hahn | 439/173 |
| 5,744,934 | A | 4/1998 | Wu | 20/111 |
| 5,848,907 | A | 12/1998 | Chen | 439/172 |
| 5,997,310 | A | 12/1999 | Chiu et al. | 439/21 |
| 6,039,608 | A | 3/2000 | Amero, Jr. et al. | 439/651 |
| 6,089,921 | A | 7/2000 | Chou | 439/640 |
| 6,109,977 | A | 8/2000 | Baxter et al. | 439/693 |
| 6,227,888 | B1 | 5/2001 | Hahn | 439/173 |
| 6,328,581 | B1 | 12/2001 | Lee et al. | 439/106 |
| 6,332,794 | B1 | 12/2001 | Tzeng Jeng | 439/188 |
| 6,364,716 | B1 | 4/2002 | Seo | 439/640 |
| 6,371,815 | B1 | 4/2002 | Wetzel et al. | 439/651 |
| 6,520,787 | B1 | 2/2003 | Lott | 439/218 |
| 6,544,058 | B1 | 4/2003 | Chang | 439/173 |
| 6,592,386 | B2 | 7/2003 | Teng et al. | 439/172 |
| 6,595,782 | B1 | 7/2003 | Hsiao | 439/13 |
| 6,638,074 | B1 | 10/2003 | Fisher | 439/22 |
| 6,669,495 | B2 | 12/2003 | Philips et al. | 439/170 |
| 6,749,451 | B2 | 6/2004 | Schmitt | 439/218 |
| 6,773,282 | B2 | 8/2004 | Alvey | 439/170 |
| 6,793,499 | B1 | 9/2004 | Chen | 439/13 |
| 6,821,134 | B2 | 11/2004 | Chen | 439/131 |
| 6,845,023 | B2 | 1/2005 | Philips et al. | 363/132 |
| 6,884,125 | B2 | 4/2005 | Chen | 439/848 |
| 6,923,667 | B1 | 8/2005 | Chen | 439/172 |
| 6,942,508 | B2 | 9/2005 | Wong | 439/171 |
| 6,988,903 | B1 | 1/2006 | Cheng | 439/137 |
| 7,008,246 | B2 | 3/2006 | Zhuge | 439/173 |
| 7,066,767 | B2 | 6/2006 | Liao | 439/639 |
| 7,168,969 | B1 | 1/2007 | Wang | 439/173 |
| 7,273,384 | B1 * | 9/2007 | So | 439/172 |
| 7,632,137 | B1 * | 12/2009 | Ma et al. | 439/518 |
| 7,874,853 | B2 * | 1/2011 | Chiang et al. | 439/173 |
| 2003/0211767 | A1 | 11/2003 | Philips et al. | 439/170 |
| 2005/0136717 | A1 | 6/2005 | Lai | 439/170 |
| 2005/0176281 | A1 | 8/2005 | Zhuge | 439/173 |
| 2006/0068608 | A1 | 3/2006 | McFadden | 439/22 |
| 2006/0141842 | A1 | 6/2006 | Sauer | 439/344 |

* cited by examiner

*Primary Examiner* — Xuong M Chung Trans
(74) *Attorney, Agent, or Firm* — Alan Kamrath; Kamrath & Associates PA

(57) ABSTRACT

A power adapter having a replaceable and rotatable plug has a body having an annular chamber, two conducting elements inside the annular chamber, four channels recessed on a top thereof to communicate with the annular chamber, and an engagement slot abutting each of the four channels; and a hollow plug having two intermediate conducting elements, a cylinder protruding beyond a bottom of the plug and received in the annular chamber, four arced holes communicating with an inner portion of the plug, four engagement blocks protruding from a cylindrical periphery to respectively correspond to the four channels and four engagement slots, and at least two prongs mounted on a top thereof, one end of each of the two prongs penetrating through the plug to electrically connect with corresponding intermediate conducting elements. Given the aforementioned structure, the plug can be replaced and selectively oriented with respect to the body.

16 Claims, 10 Drawing Sheets

POWER ADAPTER HAVING A REPLACEABLE AND ROTATABLE PLUG

BACKGROUND OF THE INVENTION

1. Field of the Invention

The present invention is related to a power adapter, and more particularly to a power adapter having a replaceable and rotatable plug.

2. Description of the Related Art

A power adapter is an essential item of electric appliances used to provide electric power. The power adapter has a body having a transformer therein and a plug fixedly mounted thereon. Plugs and sockets may vary in terms of specification and type, and the specification also varies country by country. As a result, plugs fixedly mounted on the body of conventional power adapters can not be plugged in mismatching sockets. Further, as the body in which the transformer is mounted is relatively bulky, it may obstruct other plugs from being plugged into other sockets.

SUMMARY OF THE INVENTION

An objective of the present invention is to provide a power adapter having a replaceable and rotatable plug.

To achieve the foregoing objective, the power adapter having a replaceable and rotatable plug has a body and a plug.

The body has an annular chamber, four channels, four engagement slots and two conducting elements.

The annular chamber is recessed from a top of the body. The four channels are recessed from the top to communicate with the annular chamber, and located on an inner wall of the annular chamber. The four engagement slots are formed into a bottom portion of the inner wall of the annular chamber to respectively abut the four channels. The two conducting elements are mounted inside the annular chamber.

The plug is hollow and has a base, a cap, two intermediate conducting elements, a cylinder, four arced holes, four engagement blocks, and two prongs. The cap is mounted on the base. The two intermediate conducting elements are mounted in the plug. The cylinder protrudes beyond the base and received in the annular chamber. The four arced holes are formed through a bottom of the cylinder and the base. Two opposite arced holes thereof selectively receive the two conducting elements respectively contacted with the two intermediate conducting elements. The four engagement blocks protrude from a cylindrical periphery of the cylinder to respectively correspond to the four channels and four engagement slots. The two prongs are mounted through the cap. One end of each of the two prongs penetrates through the cap to electrically connect with the corresponding intermediate conducting element.

Given the aforementioned structure, the plug can be replaced and selectively oriented with respect to the body without preventing other plugs from being plugged in the same socket.

DETAILED DESCRIPTION OF THE INVENTION

Figure 1:
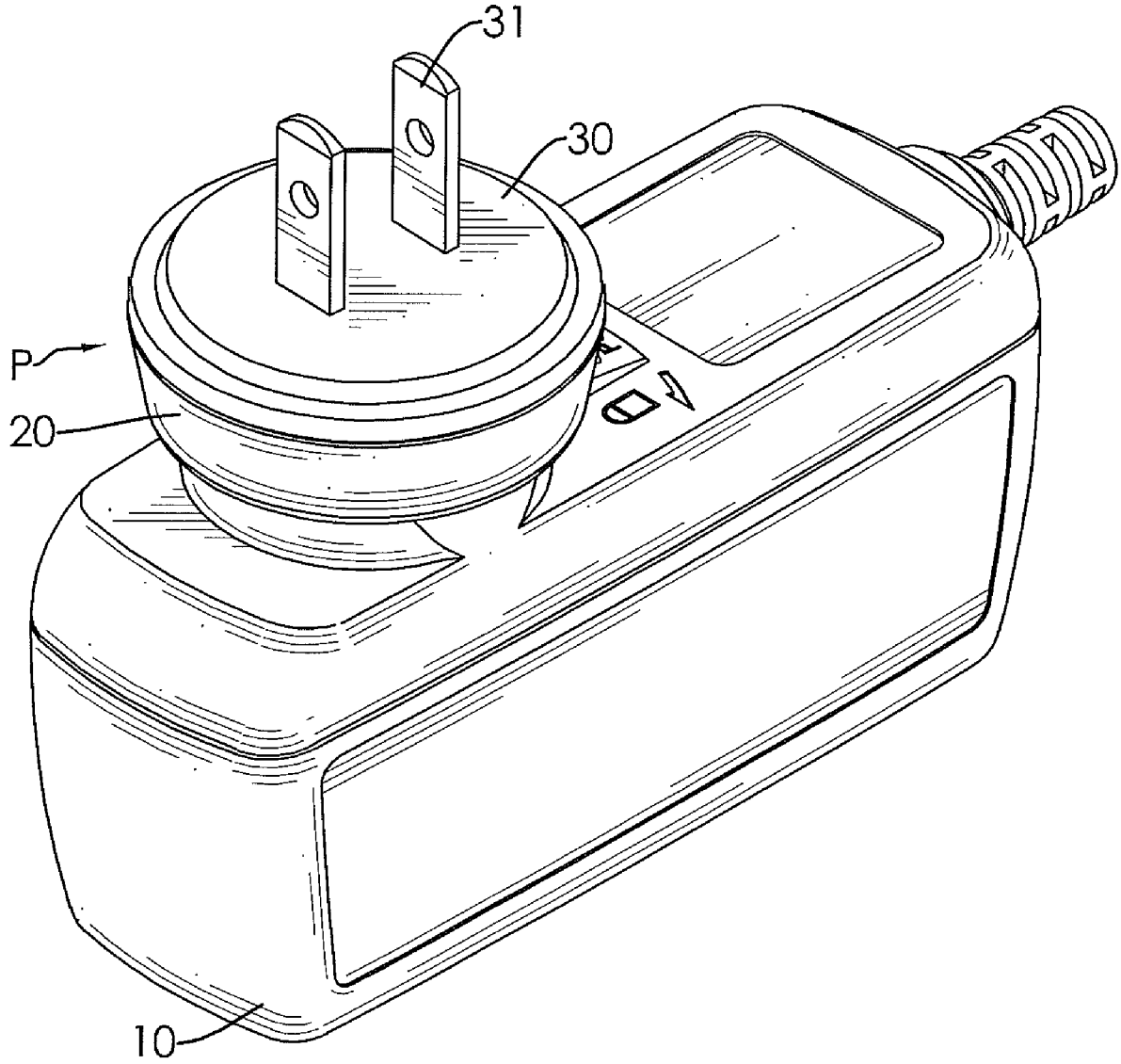
FIG. 1 is a perspective view of a first preferred embodiment of a power adapter in accordance with the present invention.
Figure 2:
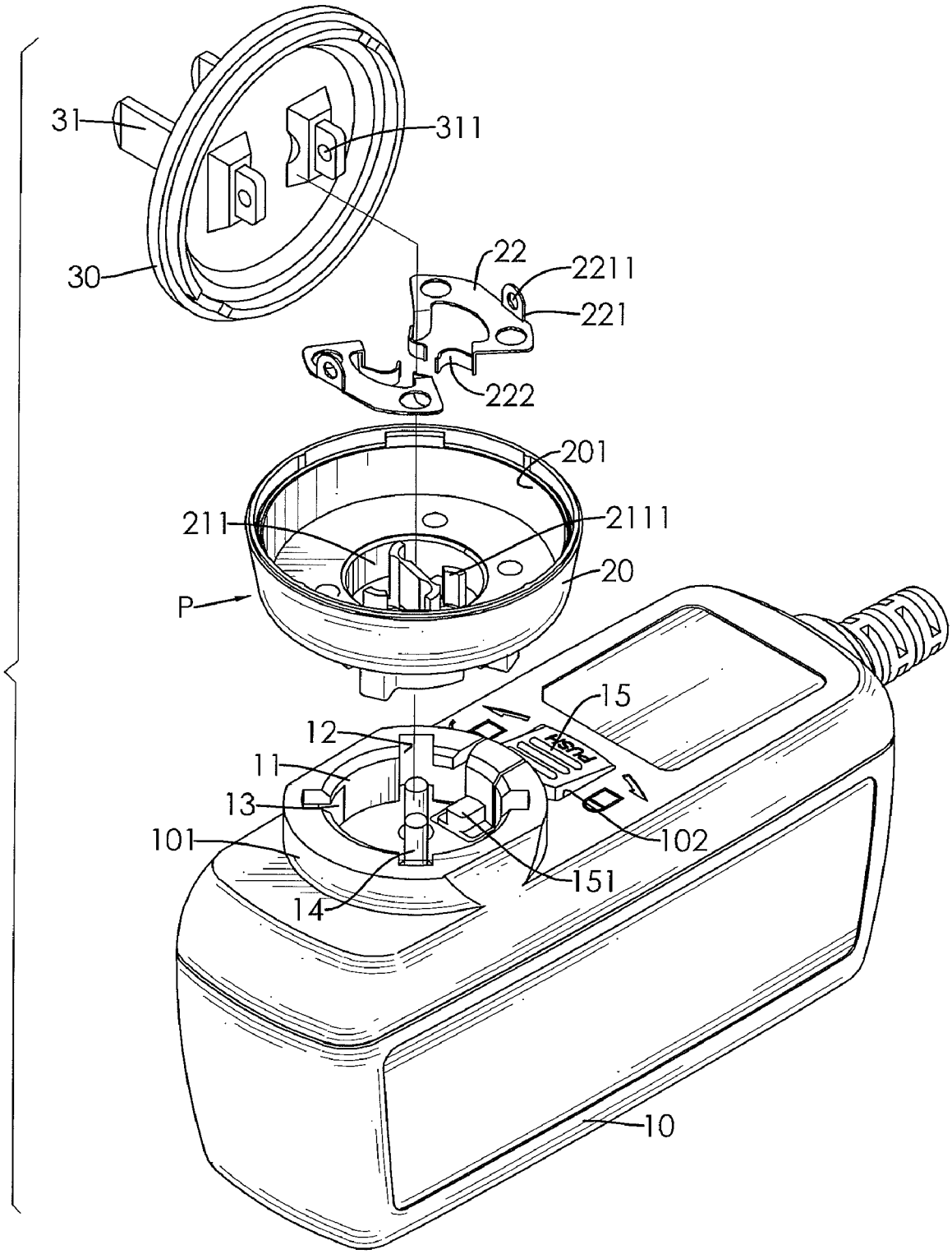
FIG. 2 is an exploded perspective view in FIG. 1.

With reference to FIGS. 1 and 2, a power adapter having a replaceable and rotatable plug has a body (10) and a plug (P).

The body (10) is hollow and has electronic components (not shown) mounted therein. A mounting seat (101) upwardly protrudes from a top surface of the body (10). A top of the mounting seat (101) is recessed to form an annular chamber (11). Four channels (12) are formed on an inner wall of the mounting seat (101) to communicate with the annular chamber (11). Four engagement slots (13) are respectively formed on bottom portions of the inner wall and respectively abut the four channels (12). Two conducting elements (14) are mounted inside the annular chamber (11) to electrically connect with the electronic components inside the body (10). A resilient button (15) is formed through the body (10) and the mounting seat (101) and is separated from the body (10). A free end of the resilient button (15) is located in the annular chamber (11) of the mounting seat (101). A snap block (151) is formed on the free end, and a top surface of the snap block (151) is higher than a bottom of the annular chamber (11).

Figure 3:
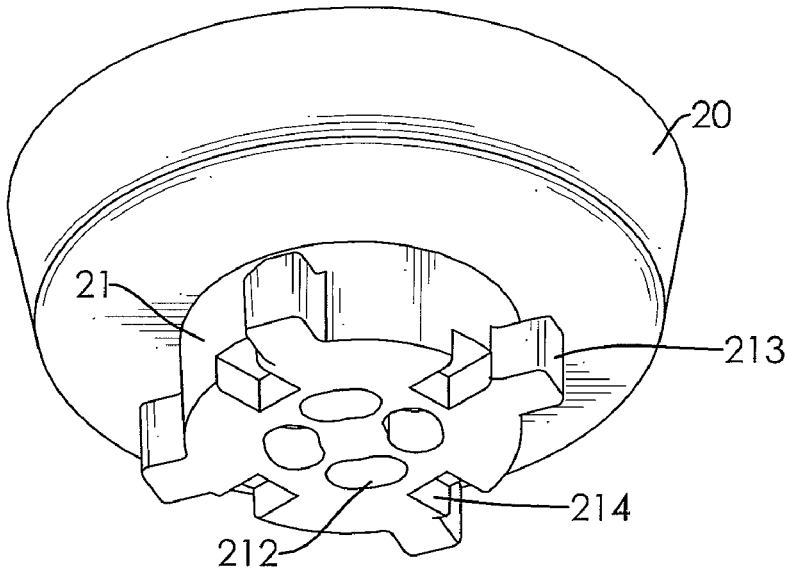
FIG. 3 is a perspective view of a base of the plug of the first preferred embodiment of the power adapter in accordance with the present invention.
Figure 4:
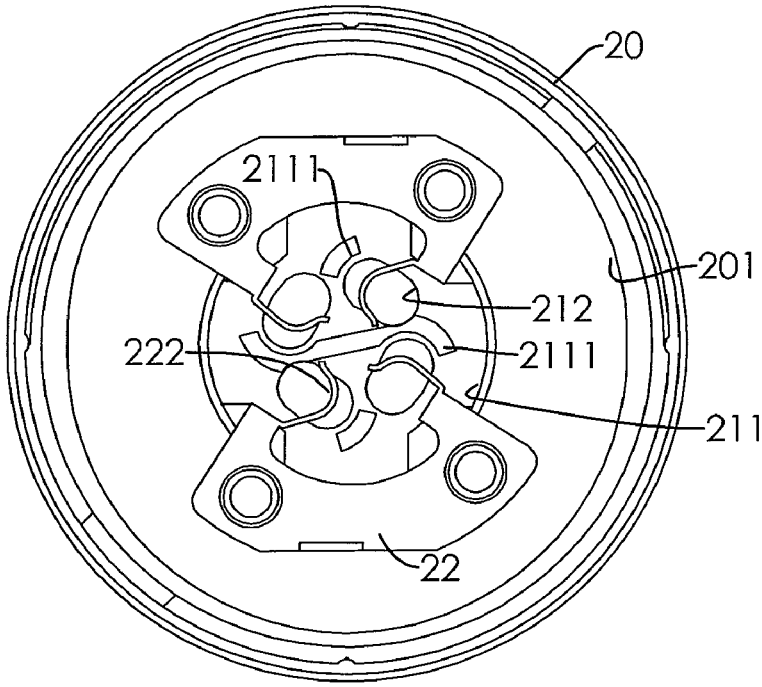
FIG. 4 is a top view in FIG. 3.

The plug (P) has a base (20) and a cap (30). With reference to FIGS. 3 and 4, the base (20) is recessed to form an upper chamber (201). A cylinder (21) downwardly projects from a bottom surface of the base (20) and is received in the annular chamber (11) when the base (20) is engaged with the mounting seat (101). The cylinder (21) has a lower chamber (211), four arced holes (212), four stoppers (2111), four engagement blocks (213), and four recesses (214). The lower chamber (211) communicates with the upper chamber (201). The four arced holes (212) are formed through a bottom of the lower chamber (211) and the cylinder (21), and the two conducting elements (14) of the body (10) are received in two opposite arced holes (212) when the base (20) is engaged with the mounting seat (101). The four stoppers (2111) upwardly extend from the bottom of the lower chamber (211) and each stopper (2111) abuts the corresponding arced hole (212). The stoppers (2111) also respectively abut the contact pieces (222) to stop the contact pieces (222). Two intermediate conducting elements (22) are mounted on a bottom of the upper chamber (201). Each intermediate conducting element (22) has a lug (221) and two contact pieces (222). The lug (221) has a lower connection hole (2211) formed through the lug (221). Each contact piece (222) is located inside the lower chamber (211) and above a corresponding arced hole (212), and abuts a corresponding stopper (2111). The four engagement blocks (213) protrude from a cylindrical periphery of the cylinder (21), and the four recesses (214) are recessed from a bottom of the cylinder (21) and respectively abut the engagement blocks (213). The four engagement blocks (213) respectively correspond to the channels (12) on the body (10) and the engagement slots (13). Each of the recesses (214) is selectively engaged with the snap block (151) on the free end of the release button (15) by pressing the release button (15) first and turning the base (20) until the snap block (151) is received in one of the recesses (214).

Figure 5:
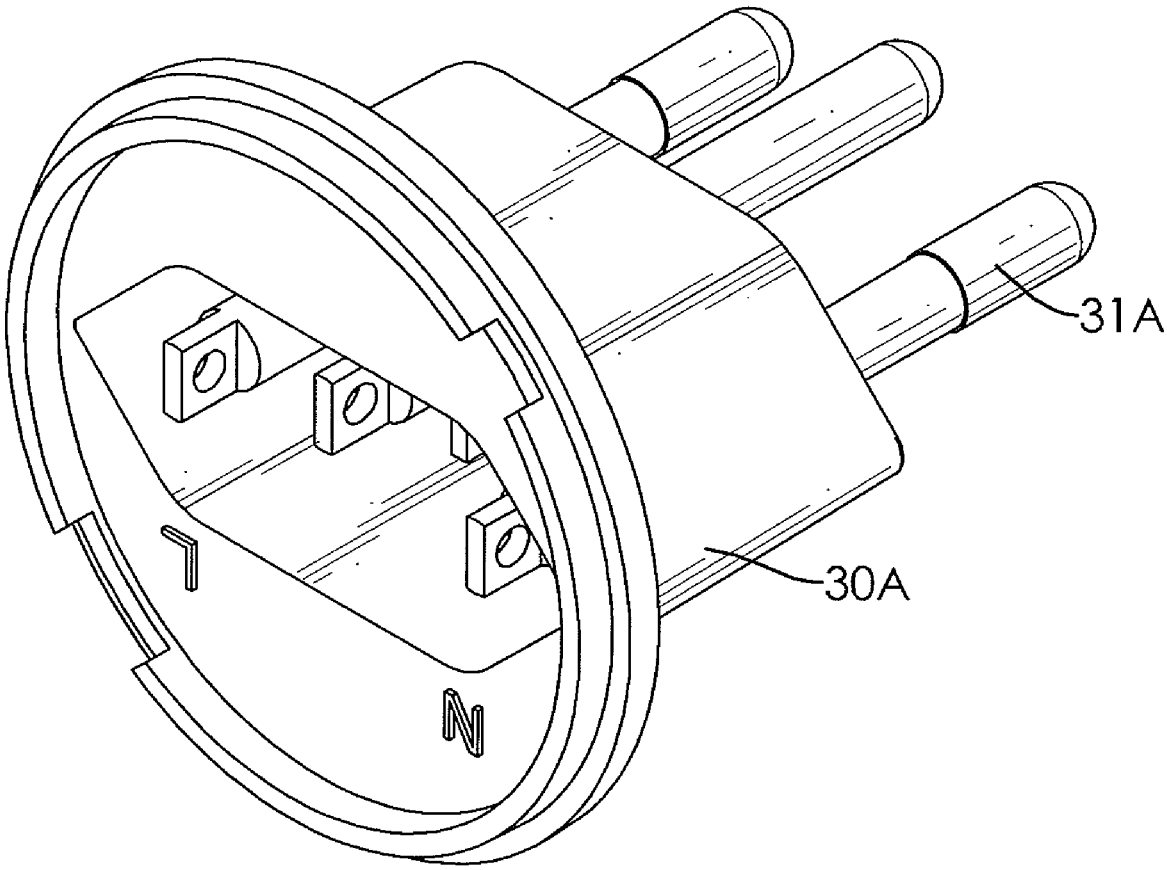
FIG. 5 is a perspective view of another plug of the present invention.

The cap (30) is covered on the base (20) to enclose the upper chamber (201) of the base (20). At least two prongs (31) are mounted through the cap (30). One end of each of the prongs (31) penetrating through the upper chamber (201) has an upper connection hole (311). Each prong (31) is electrically connected with a corresponding intermediate conducting element (22) by using a conducting material (not shown), such as metal wire, to penetrate through the upper connection hole (311) of the prong (31) and the lower connection hole (2211) of the corresponding intermediate conducting element (22). With reference to FIG. 5, a cap (30A) having three prongs (31A) of another embodiment is shown.

Figure 6:
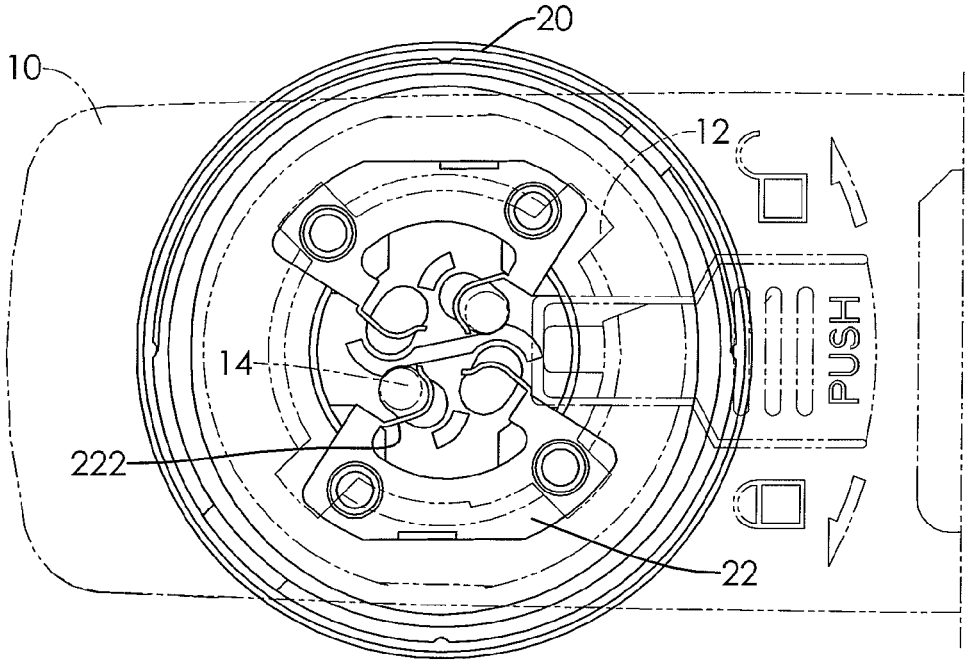
FIG. 6 is a top view of the base of the plug combined with the body of the first preferred embodiment in accordance with the present invention.
Figure 7:
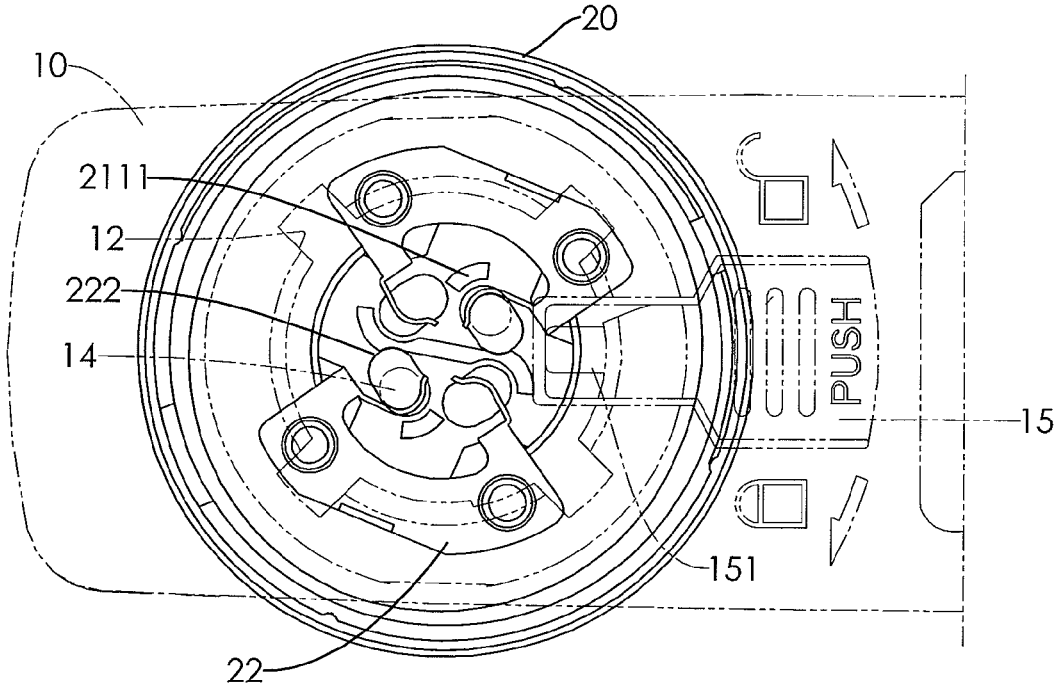
FIG. 7 is another top view of the base of the plug combined with the body of the first preferred embodiment in accordance with the present invention.
Figure 8:
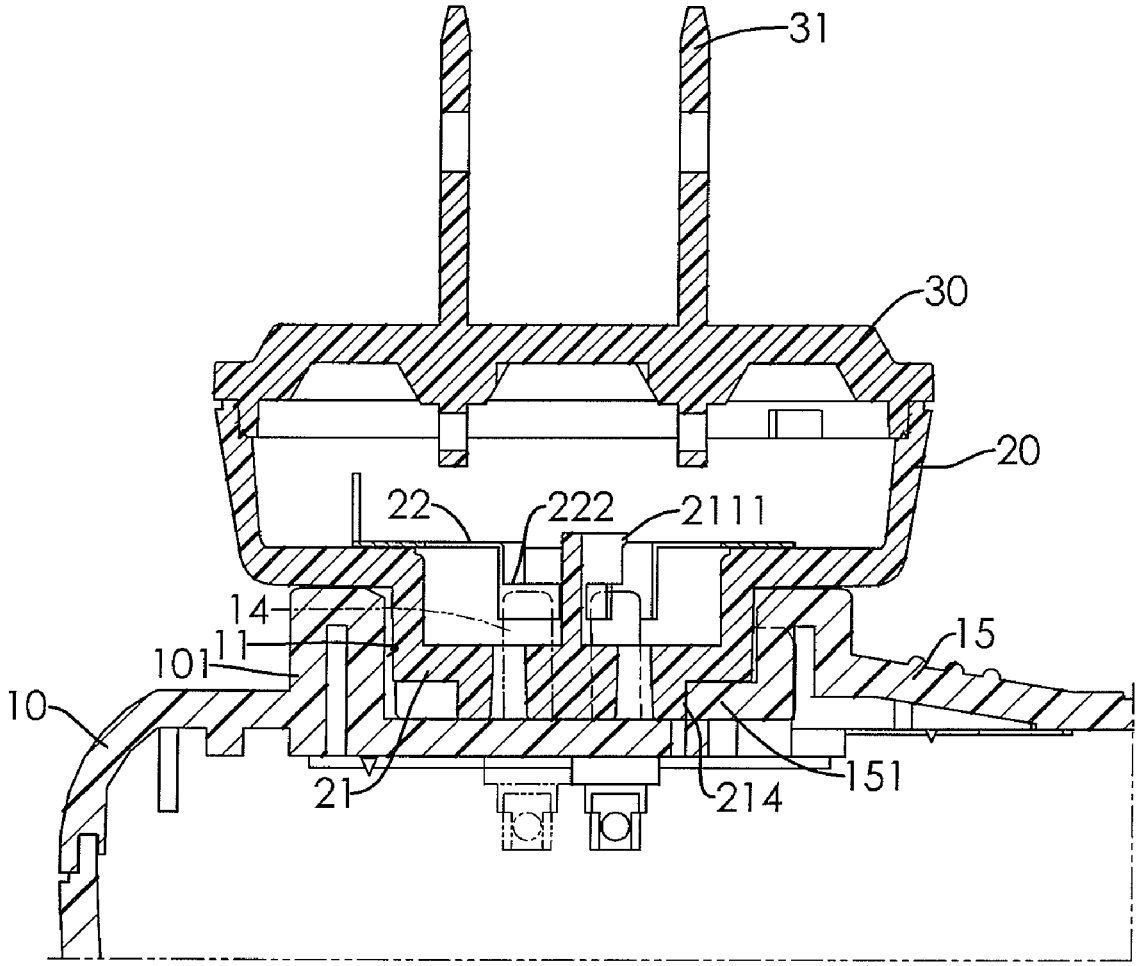
FIG. 8 is a partial cross-sectional view of the plug combined with the body of the first preferred embodiment in accordance with the present invention.

With reference to FIG. 6, when the power adapter of the present invention is ready to be used, each of the engagement blocks (213) on the cylinder (21) of the base (20) of the plug (P) is slid in the corresponding channel (12) so that the cylinder (21) is received in the annular chamber (11). The two conducting elements (14) are respectively inserted in two opposite arced holes (212) on the cylinder (21) of the plug (P). With reference to FIGS. 7 and 8, when positioned at a desired orientation, the engagement blocks (213) of the plug (P) are inserted into respective channels and rotated until the engagement blocks (213) are respectively moved from the channels (12) into the engagement slots (13), and the snap block (151) on the free end of the release button (15) is engaged with one of the recesses (214) on the cylinder (21). Meanwhile, the plug is fixed and the prongs thereof are positioned at a new position relative to the body (10). Moreover, each of the conducting elements (14) is urged against the contact piece (222) at one end of the corresponding arced hole (212) to complete the mounting of the plug (P). Each of the prongs (31) is electrically connected with the corresponding conducting element (14) through the corresponding intermediate conducting element (22), so as to prevent excessive bending. If the plug (P) needs to be removed, the release button (15) is pressed first. The snap block (151) is disengaged with the recess (214), the engagement blocks (213) are respectively moved from the engagement slots (13) into the channels (12) and then the plug (P) is removed from the mounting seat (101).

Figure 9:
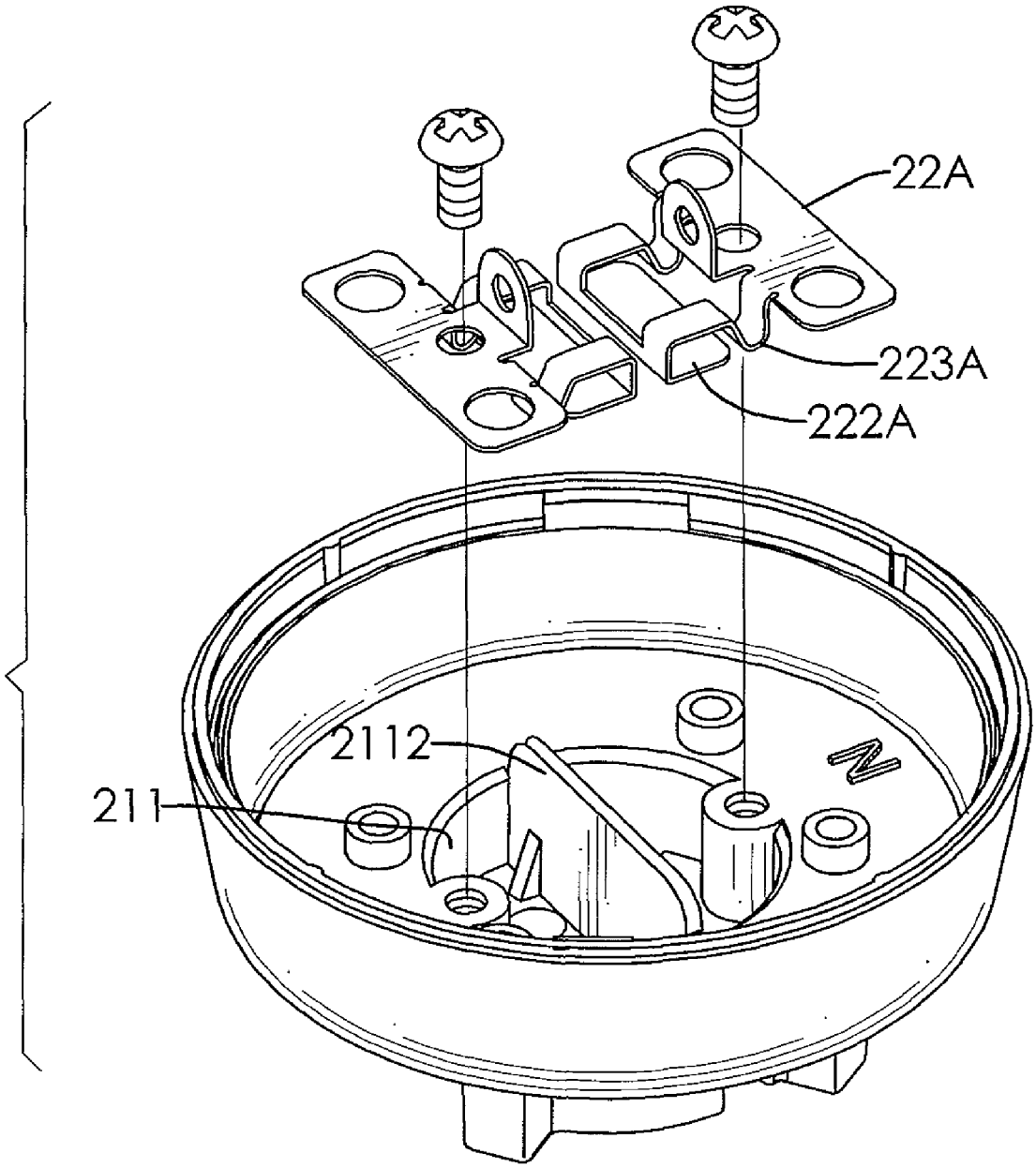
FIG. 9 is a partial exploded view of a lower cover of a second preferred embodiment of a power adapter in accordance with the present invention.
Figure 10:
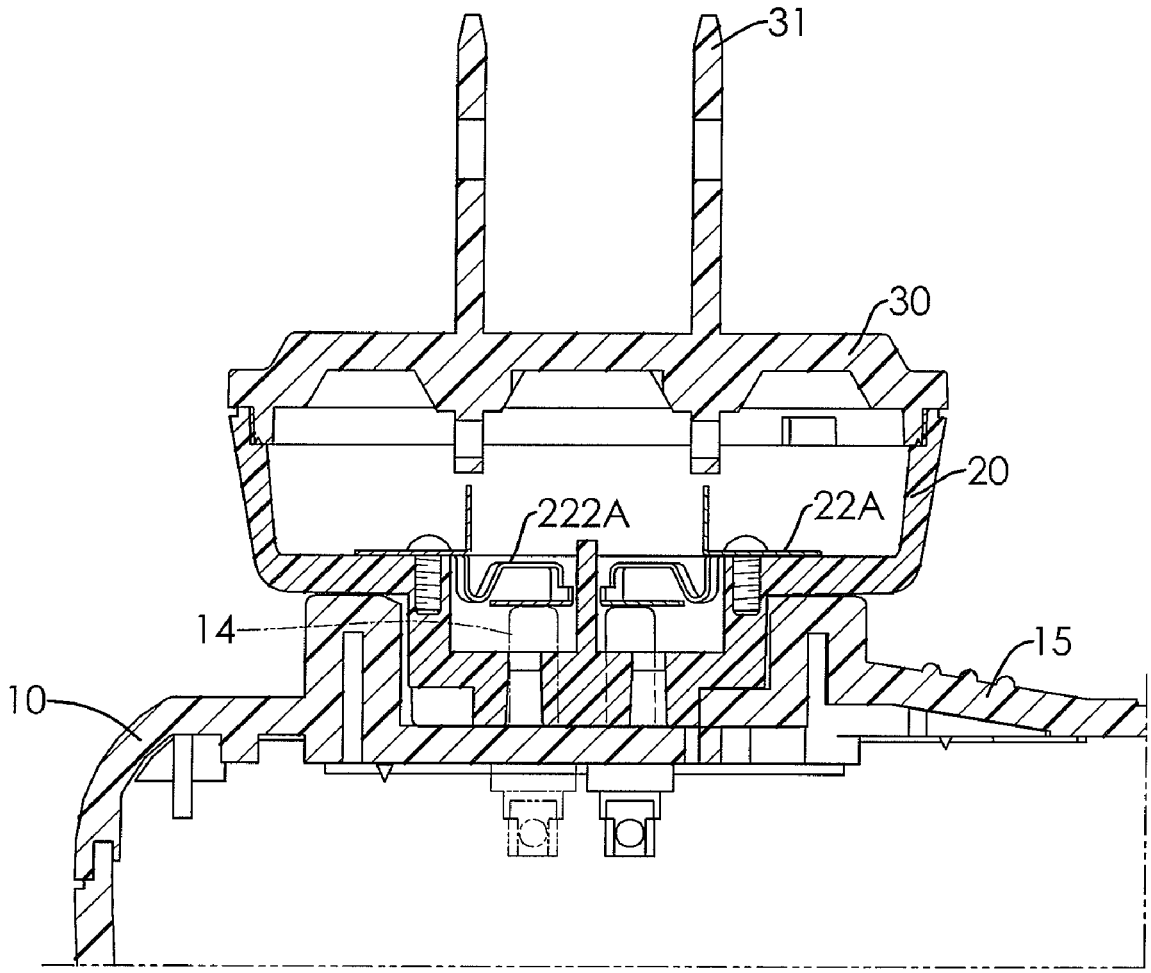
FIG. 10 is a partial cross-sectional view of the lower cover combined with a body of the second preferred embodiment in accordance with the present invention.

With reference to FIG. 9, a lower cover of a second embodiment of a power adapter of the present invention has two intermediate conducting elements (22A) and a partition (2112). Each of the two intermediate conducting elements (22A) mounted inside the base (20) of the plug (P) has a contact piece (222A) extended therefrom. Each of the two contact pieces (222A) covers two adjacent arced holes (212). At least one resilient portion (223A) is formed between the contact piece (222A) and the intermediate conducting element (22A) and takes a U-shaped form, so that the contact pieces (222A) are able to move up and down. The partition (2112) protrudes beyond the bottom of the lower chamber (211), and is located between two contact pieces (222A) to prevent the two contact pieces (222A) from contacting each other. With reference to FIG. 10, when the plug (P) is mounted on the body (10), an end of each of the two conducting elements (14) is urged against the corresponding contact piece (222A) so that the prongs (31), the intermediate conducting elements (22A) and the conducting elements (14) are electrically connected.

Figure 11A:
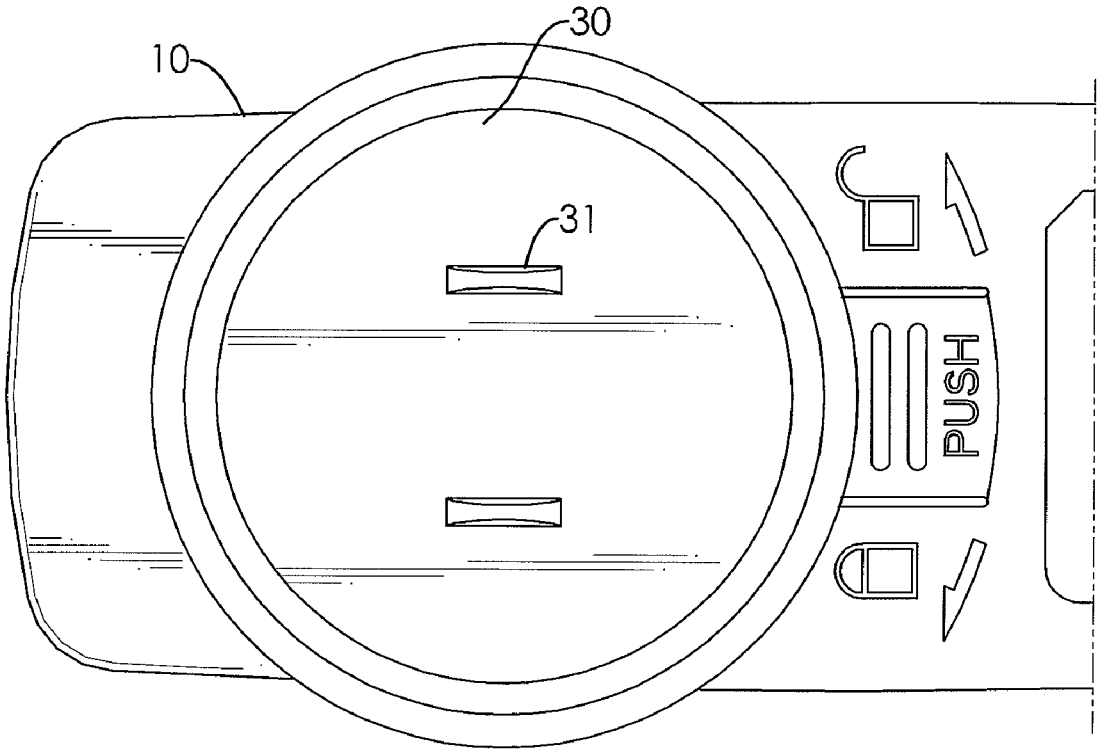
FIG. 11A is a top view of the present invention.
Figure 11B:
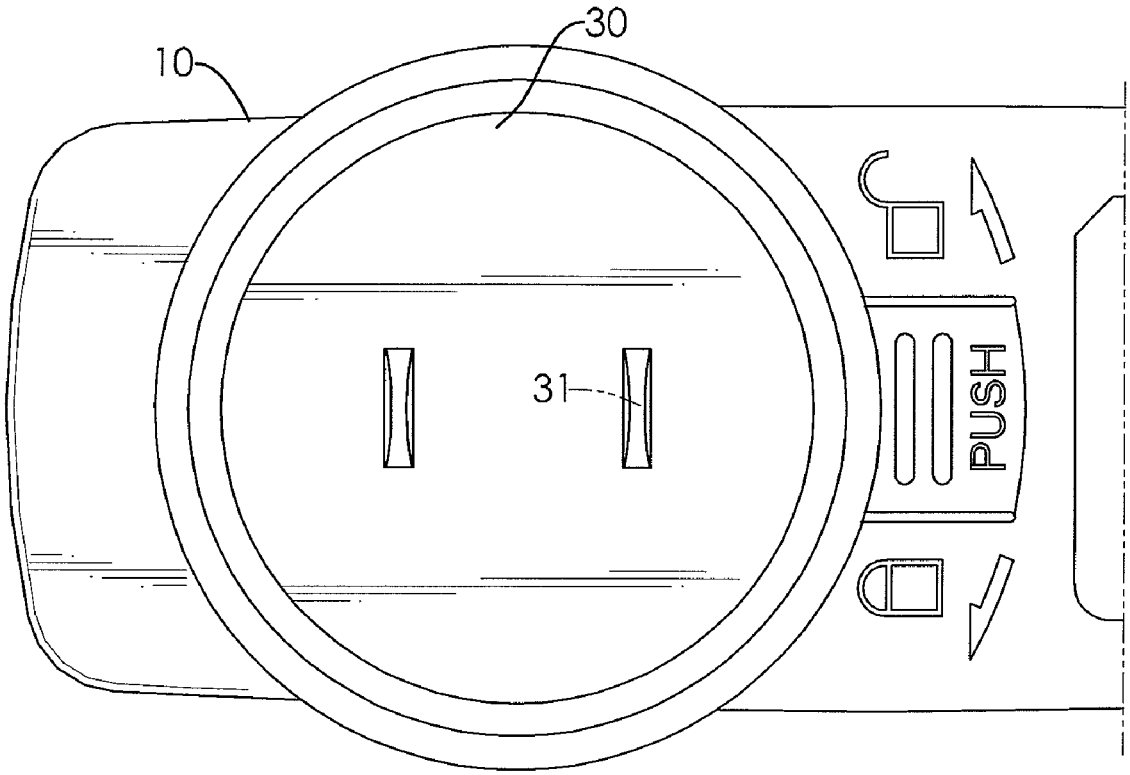
FIG. 11B is another top view of the present invention.

As the plug (P) of the present invention is separately produced as a part, a replacement plug ($P_1$) can collaborate with an existing socket. Besides, with reference to FIGS. 11A and 11B, when the plug (P) is mounted, the engagement blocks (213) respectively slide in the channels (12) so as to switch to positions of the mounted prongs (31) with respect to the body (10). Therefore, when the power adapter of the present invention is plugged into a socket, the body (10) can be positioned to allow other plugs (P) to be plugged into adjacent sockets.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power adapter having a replaceable and rotatable plug, comprising:

a body having an annular chamber recessed from a top thereof;

four channels recessed from the top to communicate with the annular chamber, and located on an inner wall of the annular chamber;

four engagement slots formed into a bottom portion of the inner wall of the annular chamber to respectively abut the four channels; and two conducting elements mounted inside the annular chamber; and a plug formed hollow and having a base;

a cap mounted on the base;

two intermediate conducting elements mounted therein;

a cylinder protruding beyond the base and received in the annular chamber;

four arced holes formed through a bottom of the cylinder and the base, two opposite arced holes thereof selectively receiving the two conducting elements respectively contacted with the two intermediate conducting elements;

four engagement blocks protruding from a cylindrical periphery of the cylinder to respectively correspond to the four channels and four engagement slots; and two prongs mounted through the cap, one end of each of the two prongs penetrating through the cap to electrically connect with the corresponding intermediate conducting element.

2. The power adapter as claimed in claim 1, wherein the base comprises:

an upper chamber protruding from a top thereof;

a lower chamber formed inside the cylinder to communicate with the upper chamber; and two contact pieces respectively extended from the two intermediate conducting elements, each of the contact pieces located in the lower chamber and above one end of the corresponding arced hole;

the cap is covered on the base to enclose the top chamber;

the arced holes are formed through a bottom of the lower chamber; and the intermediate conducting elements are mounted on a bottom of the upper chamber.

3. The power adapter as claimed in claim 2, wherein four stoppers are mounted on the bottom of the lower chamber of the base, each of the stoppers abuts one end of the corresponding arced hole and the corresponding contact piece.

4. The power adapter as claimed in claim 3, wherein each of the intermediate conducting elements inside the base has a lug having a lower connection hole thereon, one end of each of the prongs electrically connected with the corresponding intermediate conducting element and facing the upper chamber has an upper connection hole, and a conducting material penetrates through the upper connection hole and the lower connection hole to electrically connect therewith.

5. The power adapter as claimed in claim 1, wherein the base comprises:

an upper chamber protruding from a top thereof;

a lower chamber formed inside the cylinder to communicate with the upper chamber; and two contact pieces respectively extended from the two intermediate conducting elements, and located in the lower chamber to respectively cover two adjacent arced holes;

the cap is covered on the base to enclose the top chamber;

the arced holes are formed through a bottom of the lower chamber; and the intermediate conducting elements are mounted on a bottom of the upper chamber.

6. The power adapter as claimed in claim 5, wherein at least one resilient portion is formed between each of the intermediate conducting elements inside the base and the corresponding contact piece.

7. The power adapter as claimed in claim 6, wherein each of the intermediate conducting elements inside the base has a lug having a lower connection hole thereon, one end of each of the prongs electrically connected with the corresponding intermediate conducting element and facing the upper chamber has an upper connection hole, and a conducting material penetrates through the upper connection hole and the lower connection hole to electrically connect therewith.

8. The power adapter as claimed in claim 7, wherein a partition protrudes beyond the bottom of the lower chamber of the base and located between the two contact pieces.

9. The power adapter as claimed in claim 1, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

10. The power adapter as claimed in claim 2, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

11. The power adapter as claimed in claim 3, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

12. The power adapter as claimed in claim 4, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

13. The power adapter as claimed in claim 5, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

14. The power adapter as claimed in claim 6, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

15. The power adapter as claimed in claim 7, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

16. The power adapter as claimed in claim 8, wherein a release button is formed on the body, a free end of the release button is located inside the annular chamber, a snap block protrudes from the free end, four recesses are recessed from a cylindrical periphery of the cylinder, communicate with the bottom of the cylinder, and each of the recesses is selectively engaged with the snap block on the free end of the release button.

* * * * *